US007958767B2

(12) United States Patent
Janversan

(10) Patent No.: US 7,958,767 B2
(45) Date of Patent: Jun. 14, 2011

(54) DENT REMOVAL TOOL

(76) Inventor: Hamid Janversan, Salt Lake City, UT (US)

( * ) Notice: Subject to any disclaimer, the term of this patent is extended or adjusted under 35 U.S.C. 154(b) by 0 days.

(21) Appl. No.: 12/642,001

(22) Filed: Dec. 18, 2009

(65) Prior Publication Data

US 2010/0294018 A1 Nov. 25, 2010

Related U.S. Application Data

(60) Provisional application No. 61/180,844, filed on May 23, 2009.

(51) Int. Cl.
*B21D 1/12* (2006.01)
*B21J 13/08* (2006.01)

(52) U.S. Cl. ..... 72/459; 72/325; 72/372; 72/458; 72/479; 72/705

(58) Field of Classification Search ..... 72/309, 72/325, 372, 457, 458, 465.1, 466.6, 479, 72/480, 705, 459
See application file for complete search history.

(56) References Cited

U.S. PATENT DOCUMENTS 1,737,084 A * 11/1929 Hilstad ..... 72/458
2,191,720 A * 2/1940 Meinhardt ..... 72/458
2,749,795 A * 6/1956 Boykin, Jr. ..... 72/458
2,776,587 A * 1/1957 Killius ..... 72/458
2,852,971 A * 9/1958 Macaluso, Jr. ..... 72/458
2,922,326 A * 1/1960 Martin ..... 72/458
2,957,376 A 10/1960 Parisi
3,091,983 A 6/1963 Kliss
3,359,778 A * 12/1967 Di Maio ..... 29/243.528
3,712,106 A 1/1973 Holsapple et al.
4,026,139 A 5/1977 Glaser et al.
4,037,448 A 7/1977 Di Maio et al.
4,072,042 A 2/1978 Servin et al.
4,073,181 A 2/1978 Steinmann, Jr.
4,088,004 A * 5/1978 Di Maio et al. ..... 29/243.528
4,089,201 A 5/1978 Raptis
4,116,035 A 9/1978 Malarsky
4,208,901 A * 6/1980 Elflein ..... 29/243.521
4,235,090 A 11/1980 Wightman et al.
4,289,017 A 9/1981 Guidry
4,300,382 A 11/1981 Meek
4,429,562 A 2/1984 Hultquist
4,476,705 A 10/1984 Meek
4,502,317 A 3/1985 Hultquist
4,503,701 A 3/1985 Hardy
4,827,759 A 5/1989 Mattson
4,924,056 A 5/1990 Bevilacqua
4,930,335 A 6/1990 Ishihara
5,113,687 A 5/1992 Palmgren
5,203,196 A 4/1993 Jenkins
6,014,885 A 1/2000 Griffaton
6,489,011 B2 12/2002 Uegaki
6,539,770 B2 4/2003 Olsson
6,557,231 B1 5/2003 Uegaki
6,655,185 B2 12/2003 Uegaki (Continued)

*Primary Examiner* — David B Jones
(74) *Attorney, Agent, or Firm* — Bateman IP Law Group; Brett Peterson

(57) ABSTRACT

A dent removal tool for removing dents from automobile panels is provided. The tool includes a body with a handle on one end and a rest plate for contacting the body panel on the opposite end. A clamp for gripping one or more studs which have been welded to the body panel is located between the handle and the rest plate. The tool gives an automobile repair technician a high degree of mechanical advantage and control in removing dents from body panels.

20 Claims, 6 Drawing Sheets

U.S. PATENT DOCUMENTS

| | | | |
|---|---|---|---|
| 6,722,179 | B1 | 4/2004 | Ventura |
| 6,792,790 | B2 | 9/2004 | Ritter |
| 6,957,559 | B2 | 10/2005 | Venalainen |
| 6,964,186 | B1 | 11/2005 | Strasser et al. |
| 7,181,951 | B1 | 2/2007 | Schmidt |
| 7,191,634 | B1 | 3/2007 | Borgos, III |
| 2002/0022119 | A1 | 2/2002 | Uegaki |
| 2002/0022897 | A1 | 2/2002 | Uegaki |
| 2002/0035863 | A1 | 3/2002 | Lowery |
| 2003/0070470 | A1 | 4/2003 | Uegaki |
| 2005/0076700 | A1 | 4/2005 | Venalainen |

* cited by examiner

DENT REMOVAL TOOL

PRIORITY

The present application claims the benefit of U.S. Provisional Application Ser. No. 61/180,844, filed May 23, 2009, which is herein incorporated by reference in its entirety.

THE FIELD OF THE INVENTION

The present invention relates to repair of automobile bodies and the like. More specifically, the present invention relates to a dent removal tool for removing dents from a vehicle body.

BACKGROUND

Repairing damaged automobile body panels forms a great portion of the duties of auto body technicians. Auto body technicians have historically used a variety of different techniques and tools to remove dents and otherwise repair automobile body panels. If a damaged body panel is accessible from behind, a hammer and dolly may be used to shape the panel to the correct form. Various body fillers are used to finish the repair. However, there are many occasions that accessing a panel may not be possible or feasible and other repair methods are necessary.

Time is a significant concern in repairing automobiles, since the labor cost is often a significant portion of the total repair costs. Thus, technicians and repair shops are desirous for faster and easier ways to properly repair body damage. Technicians have made one or more holes in the area being repaired and, with the help of a hook or a slide hammer screwed in the hole, they would pull the dent out. This required that the hole had to be welded which increased the repair time and could compromise the strength of the body panel being repaired. In order to avoid drilling holes in the body panel, technicians began welding studs to the repair area. The stud itself would be held and pulled by various tools such as a slide hammer in order to pull the dented area along with the tool and repair the dent. After repairing the dent, the stud was simply cut and ground off, leaving no holes in the body panel.

While many systems have been created for pulling studs to repair dents, these are often quite expensive and cumbersome to setup and operate. These systems often require specialized tools and studs, increasing the costs of the repair and in some cases making it more difficult to use a specialized tool in combination with a more generic tool while working on the same repair. Many of the available stud pulling systems are rather large, and thus are generally not readily available at the repair site and require transport to the site and set up time. Because of the expense of the dent pulling systems, a body shop may have a limited number of these tools and technicians may not have the tools immediately available when needed. In addition, since these systems are non-standard, they require training.

Despite the drawbacks described above, the use of the welded studs remains the general practice of the industry for pulling and repairing dents. It is, however, desirable to have tools for pulling the studs which are more easily used and which are less expensive than available dent removal systems.

SUMMARY OF THE INVENTION

It is an object of the present invention to provide an improved tool for use with welded studs in removing dents from automobile bodies.

A device is provided for removing dents from sheet metal panels. The device includes a lever with a handle on the first end. At the second end of the lever, a rest plate is attached. Between the first and second ends is a set of gripping jaws actuated by a control rod that grips and holds a stud which has been welded to the damaged area of the automobile panel. Once a stud is gripped in the jaws, the operator pulls the lever outwardly from the automobile panel, thereby pulling the dented area to the pre-accident shape. The grip on the stud is then released. The rest plate contacts the automobile panel while using the tool, and pivots to allow the lever body to pivot outwardly and pull on the stud.

The device may be used to grip a single stud, or may also be used to grip multiple studs at the same time. As such, the device may be used to correct various different types of damage in an automobile body panel.

The device allows a stud to be pulled with one hand, leaving the technician one hand free to use other tools, such as using a hammer to tap the surrounding area, as is required in many situations.

The device is advantageous over available devices for removing dents as it is quite simple and inexpensive, allowing the tool to be more widely used by automobile technicians.

These and other aspects of the present invention are realized in a dent removal tool as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1A:
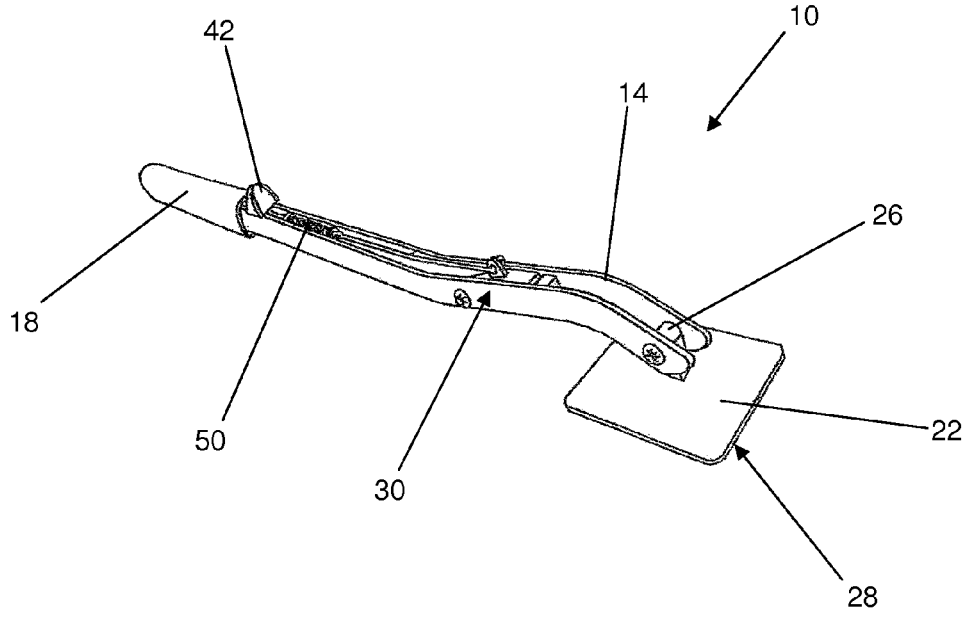
FIG. 1*a* is a perspective illustration of a dent removal tool according to the present invention.
Figure 1B:
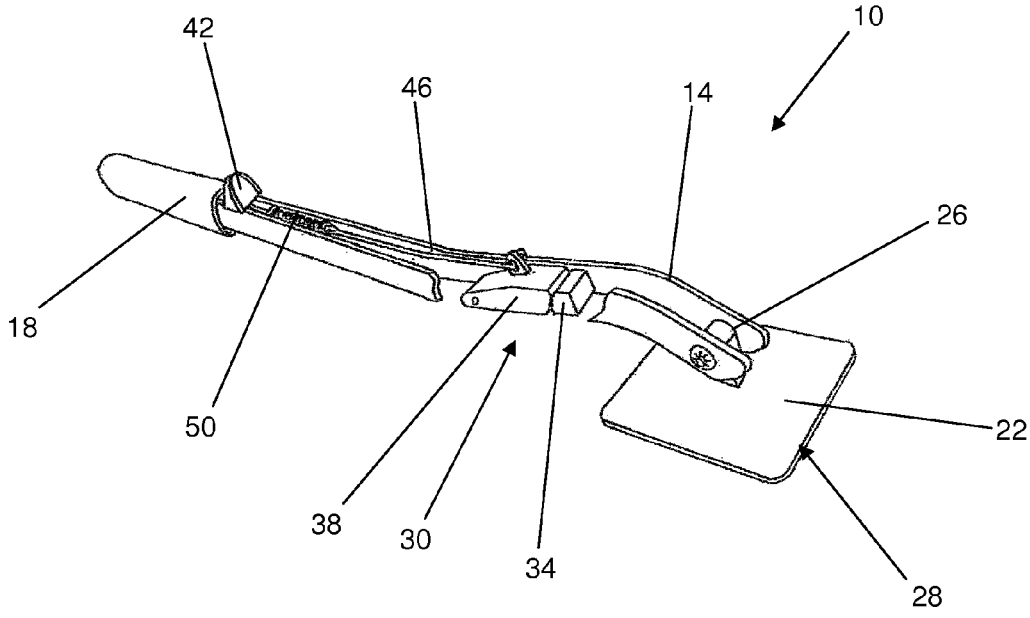
FIG. 1*b* is a partially cut-away perspective illustration of the tool of FIG. 1.
Figure 2A:
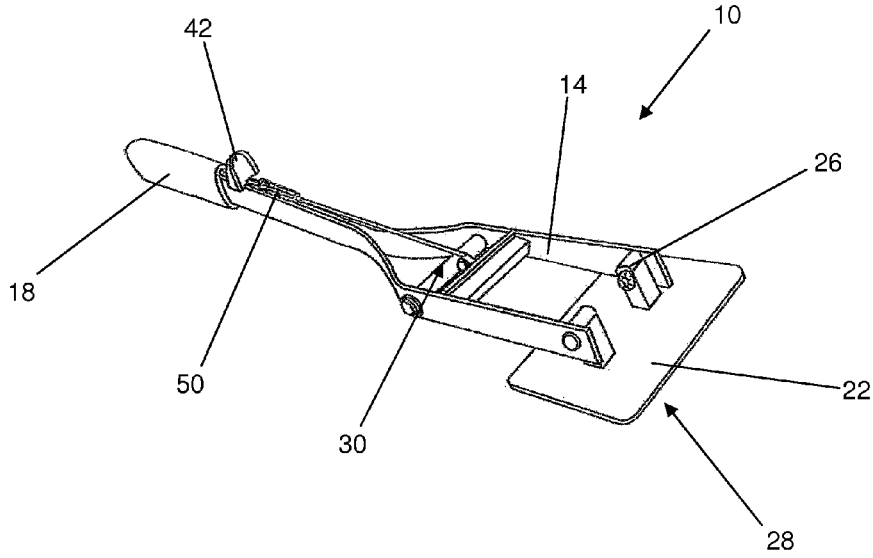
FIG. 2*a* is a perspective illustration of a wider version of the tool of FIG. 1 designed for gripping more than one stud at a time.
Figure 2B:
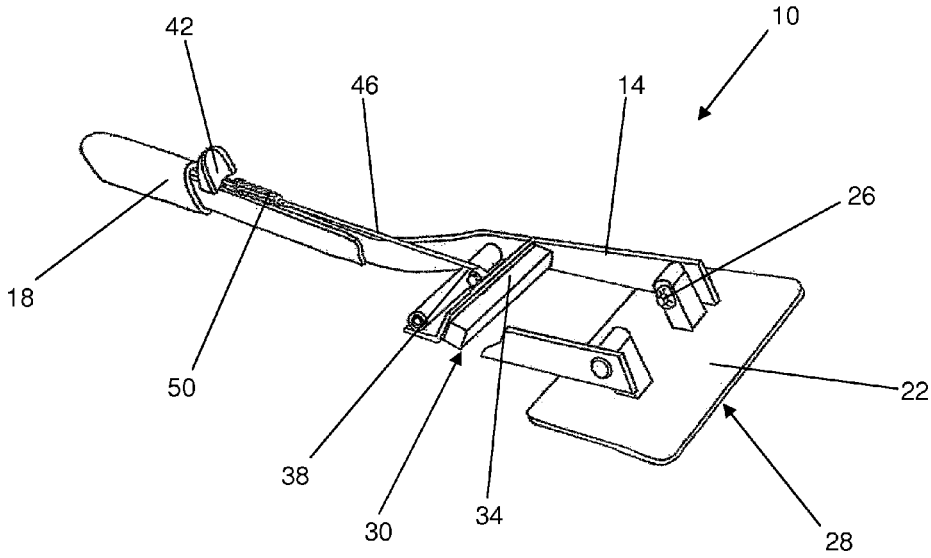
FIG. 2*b* is a partially cut-away perspective illustration of the tool of FIG. 2*a;*

Turning now to FIGS. 1*a* through 2*b*, perspective views of the device of the present invention are shown. The devices of FIGS. 1*a* and 1*b* differ from the devices of FIGS. 2*a* and 2*b* in that the device of FIGS. 2*a* and 2*b* is wider and can grip multiple studs at once. FIGS. 1*b* and 2*b* show partially cut away views of FIGS. 1*a* and 2*a*, respectively. The dent removal tool 10 has a body 14. A handle 18 is located at an end of the body 14, and a rest plate 22 is attached to the opposite end of the body 14 via pivot 26. The rest plate typically has a pad 28 attached to the lower side thereof. A clamp 30 is attached to the body 14. The clamp 30 is located between the handle 18 and the rest plate 22, at a distance away from the rest plate of between approximately fifteen and thirty percent of the length of the body 14. The clamp 30 is used to grip studs which have been welded to an automobile body.

The clamp includes a stationary jaw 34 which is rigidly attached to the body 14 and a movable jaw 38 which is pivotably attached to the body. The movable jaw 38 can pivot upwardly and away from the stationary jaw 34. The movable jaw 38 is biased to pivot towards the stationary jaw 34 so as to increase the ease and reliability of using the tool 10. As shown, the movable jaw 38 is moved away from the stationary jaw 34 when a user pulls on a thumb grip 42 located adjacent the handle 18. The thumb grip 42 is connected to the movable jaw 38 via a metal rod 46, and a spring 50 is located along the rod to bias the movable jaw 38 towards the stationary jaw 34.

Figure 3:
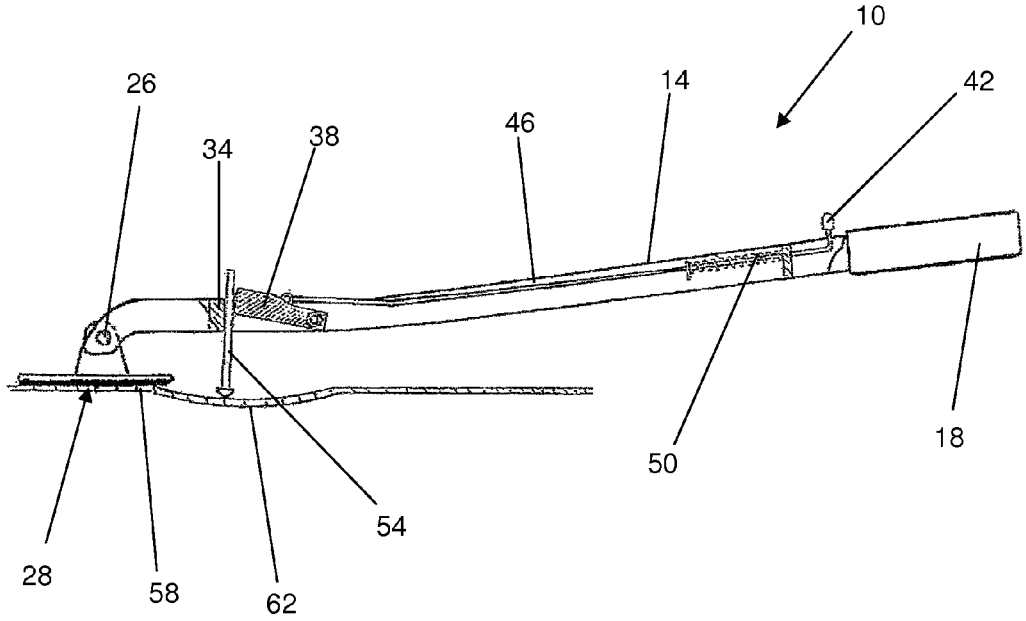
FIG. 3 illustrates the use of the tool of FIG. 1.

FIG. 3 shows a side view of the dent removal tool 10, illustrating how the tool is used. A metal stud 54 is welded to an automobile body panel 58 at a desired location in a dent 62. The dent removal tool 10 is then placed so that the rest plate 22 and pad 28 are placed against the body panel 58 and so that the stud 54 is placed between the stationary jaw 34 and the movable jaw 38. The user will typically use the thumb grip 42 to open the movable jaw 38 to receive the stud. The spring 50, located between a flange on the body 14 and a stop on the rod 46, biases the movable jaw 38 against the stationary jaw 34. Once the tool 10 is in the position shown, a user will hold the handle 18 and pull the handle away from the body panel 58 so that the stud 54 and dent 62 are also pulled outwardly. Multiple studs 54 are typically used to remove a dent. As such, the tool 10 may be made wider as shown in FIGS. 2*a* and 2*b* in order to allow the tool to grip multiple studs at the same time.

Figure 4A:
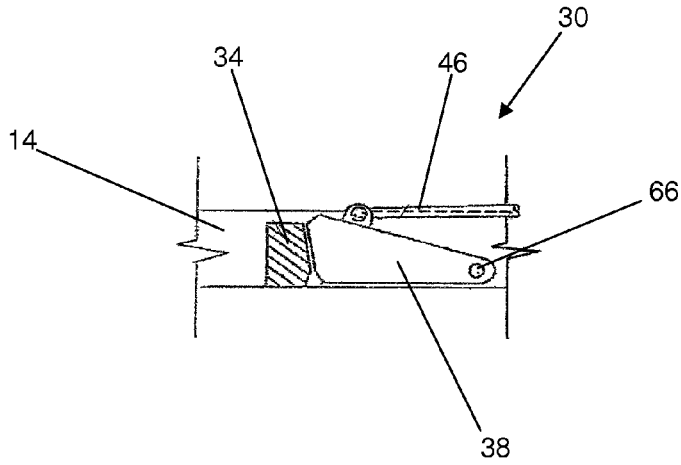
FIGS. 4*a* through 4*c* show a detailed view of the tool of FIG. 1.
Figure 4B:
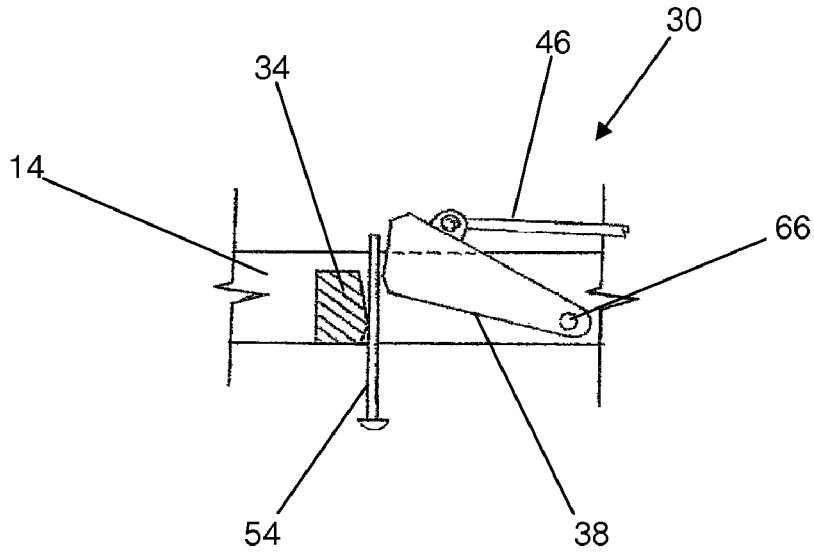
Figure 4C:
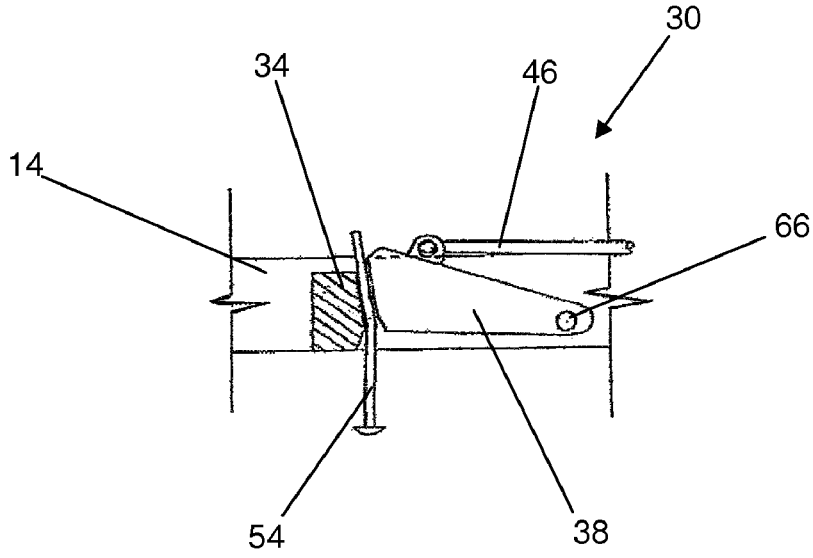
Figure 5:
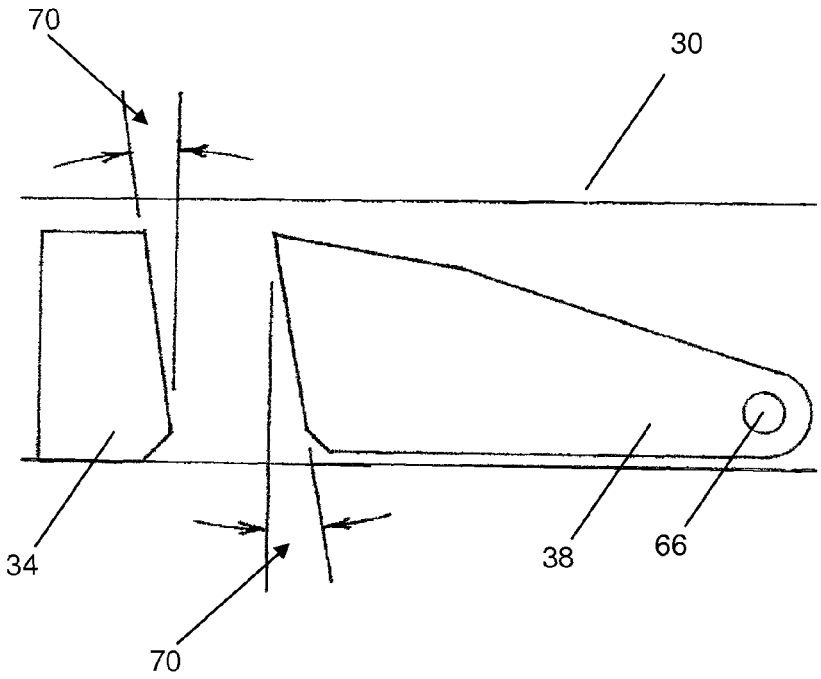
FIG. 5 shows additional details of the gripping jaws of the present tool.

Turning to FIGS. 4*a* through 4*c* and FIG. 5, additional details of the clamp 30 are shown. As shown in FIG. 5, the clamp jaws 34, 38 are angled towards the rest plate 22 as indicated at angle 70. Preferably, the jaws 34, 38 are angled forwards by between approximately five and ten degrees, and more preferably by about seven degrees. This bends the stud 62 somewhat, and helps to grip the stud. A device as shown in FIGS. 1*a* and 1*b* will often have stationary and movable jaws 34, 38 which are between about 0.5 and 1 inch wide and will grip a single stud 62 or a few closely spaced studs. A device as shown in FIGS. 2*a* and 2*b* will often have stationary and movable jaws 34, 38 which are between about 2 and 2.5 inches wide and will grip multiple studs which are spaced apart by a few inches.

FIG. 4*a* shows the movable jaw 38 in a closed position. It can be observed how the jaws are sloped towards the rest plate 22. The rod 46 is attached to the movable jaw 38, and used to pivot the jaw away from the stationary jaw 34, as shown in FIG. 4*b*. The movable jaw is attached to the body 14 via pivot 66. Once the movable jaw 38 is pivoted away from the stationary jaw 34 a sufficient amount, the stud 54 is placed therebetween. The spring 50 urges the movable jaw 38 towards the stationary jaw 34 and maintains contact between the jaws 34, 38 and the stud 54. When the handle 18 is pulled away from the body panel to remove the dent, the stud 54 is bent against the stationary jaw 34 and the movable jaw 38 is pulled more tightly against the stud 54.

Figure 6:
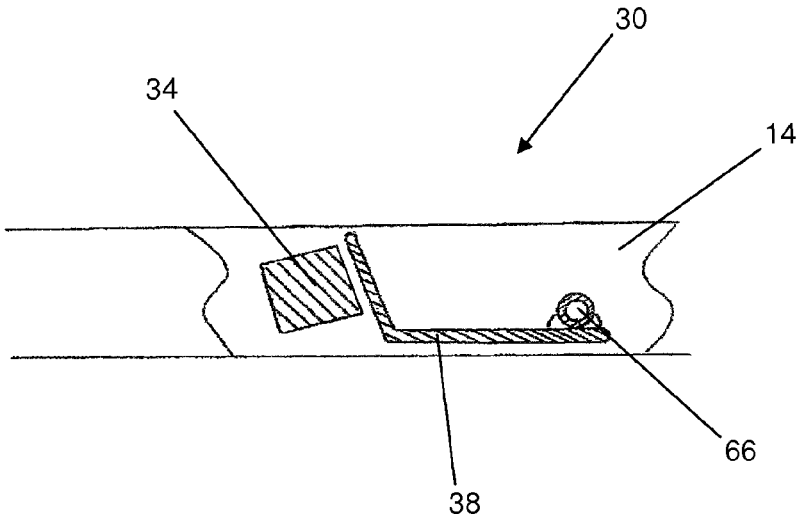
FIG. 6 shows an alternate design for the gripping jaws of the present tool.
Figure 7A:
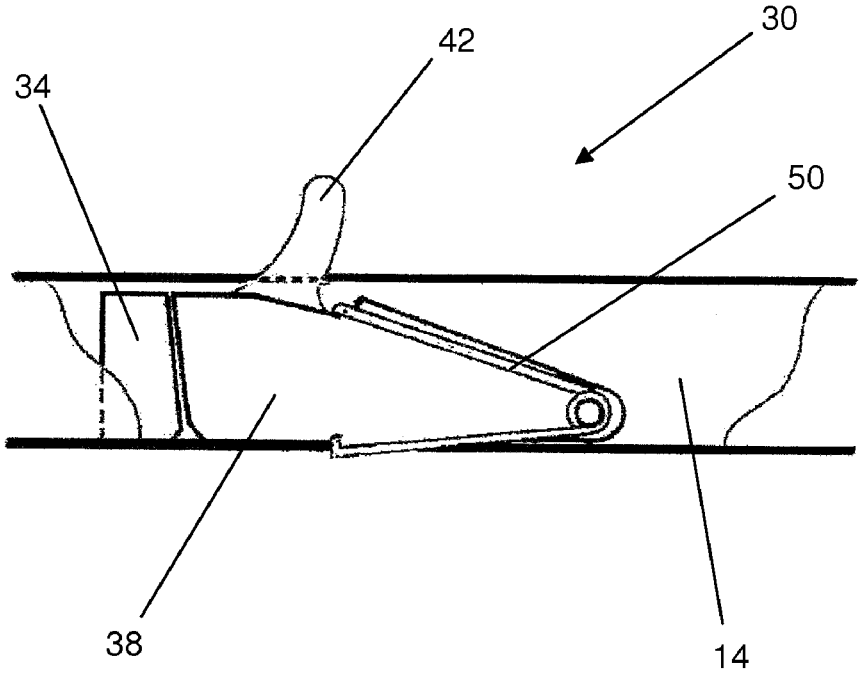
FIGS. 7*a* and 7*b* show alternate designs of the gripping jaws of the present tool.
Figure 7B:
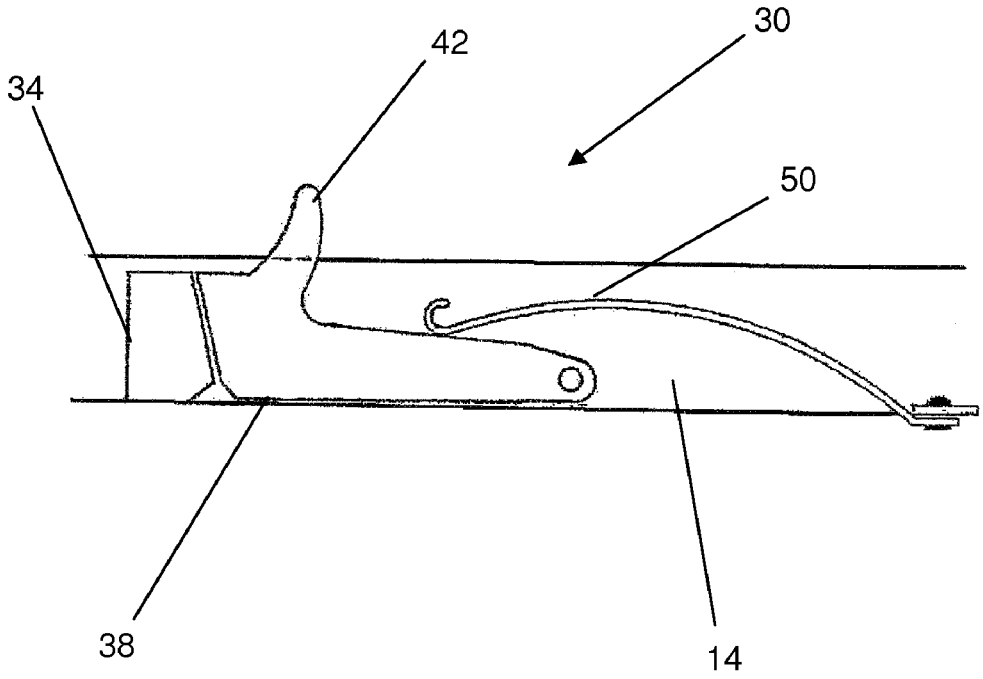

FIG. 6 shows an alternate construction of the clamp 30. It is appreciated how the shape or construction of the jaws 34, 38 can be changed somewhat while keeping the same functional geometry of the jaws 34, 38. FIGS. 7*a* and 7*b* show additional alternate constructions of the clamp 30. In these figures, the thumb grip 42 is located on the movable jaw 38. The spring 50 acts directly on the movable jaw 38, and the rod 46 is eliminated. The spring 50 may be a leaf spring as shown in FIG. 7*b* or a torsion spring as shown in FIG. 7*a*. Both of these designs retain the functionality discussed above.

While using the dent removal tool 10, the rest plate 22 sits on the surface of the body panel 58 to distribute force over the panel and prevents distortion of the panel. The construction of the body 14 and the location of the clamp 30 between the rest plate 22 and the handle 18 provides a high degree of mechanical advantage in pulling out a dent. This gives the technician the ability to pull the dent out with one hand while retaining a high degree of control and accuracy. The technician may use another tool such as a hammer while pulling the dent out as the tool 10 may be operated with one hand. This makes it easier for the technician to remove the dent.

There is thus disclosed an improved automotive dent removal tool. It will be appreciated that numerous changes may be made to the present invention without departing from the scope of the claims.

What is claimed is:

1. A tool for removing dents from body panels comprising:
an elongate body;
a handle located at a first end of the body;
a rest plate pivotably attached to a second end of the body; and
a clamp attached to the body between the rest plate and the handle, the clamp being configured for gripping a stud which has been attached to a body panel and extending from the body panel; and
wherein the clamp comprises a stationary jaw and a movable jaw, and wherein the movable jaw is pivotably mounted to the body.

2. The tool of claim 1, wherein the clamp is located along the body at a distance from the rest plate pivot of between 15 and 30 percent of the length of the body.

3. The tool of claim 1, further comprising a grip and a rod connecting the grip to the movable jaw, the grip being movable to pivot the movable jaw away from the stationary jaw.

4. The tool of claim 1, wherein the face of the stationary jaw is angled towards the rest plate pivot by between 5 and 10 degrees.

5. The tool of claim 1, wherein the face of the stationary jaw is angled towards the rest plate pivot by about 7 degrees.

6. The tool of claim 1, wherein the movable jaw is biased to pivot towards the stationary jaw.

7. The tool of claim 6, further comprising a grip for allowing a user to pivot the movable jaw away from the stationary jaw.

8. The tool of claim 7, wherein the grip is a thumb grip disposed adjacent the handle.

9. The tool of claim 1, further comprising a grip disposed adjacent the handle and connected to the movable jaw, the grip being configured for allowing a user to pivot the movable jaw away from the stationary jaw.

10. The tool of claim 1, wherein the clamp extends laterally to grip multiple studs at the same time.

11. The tool of claim 1, wherein the stationary and movable jaws extend laterally across the body of the tool.

12. The tool of claim 11, wherein the stationary and movable jaws are between about 0.5 and 2 inches wide.

13. A tool for removing dents from a body panel comprising:

an elongate body;

a handle on the first end of the body;

a rest plate pivotably attached to the second end of the body;

a pad located on the bottom side of the rest plate;

a stationary clamp jaw attached to the body between the rest plate and the handle; and a movable clamp jaw pivotably attached to the body and pivotable from a position adjacent the stationary clamp jaw to a position away from the stationary clamp jaw.

14. The tool of claim 13, further comprising a spring for biasing the movable clamp jaw into the position adjacent the stationary clamp jaw.

15. The tool of claim 14, further comprising a grip attached adjacent the handle and connected to the movable clamp jaw and configured for allowing a user to move the movable clamp jaw away from the stationary clamp jaw.

16. The tool of claim 13, wherein the stationary clamp jaw has a clamping face which is angled towards the rest plate by an angle between 5 and 10 degrees.

17. The tool of claim 13, wherein the stationary clamp jaw has a clamping face which is angled towards the rest plate by an angle of about 7 degrees.

18. The tool of claim 13, wherein the stationary clamp jaw and the movable clamp jaw extend laterally across the body and are between about 0.5 and 2.5 inches wide.

19. The tool of claim 13, wherein the stationary clamp jaw and the movable clamp jaw extend laterally across the body and are of sufficient width to permit the gripping of multiple autobody studs simultaneously.

20. The tool of claim 15, wherein the grip is connected to the movable jaw via a rod.

* * * * *